US010000059B2

(12) United States Patent
Kondo

(10) Patent No.: US 10,000,059 B2
(45) Date of Patent: Jun. 19, 2018

(54) PRINTING APPARATUS AND TRANSMISSION CABLE

(71) Applicant: Seiko Epson Corporation, Tokyo (JP)

(72) Inventor: Yoichiro Kondo, Chino (JP)

(73) Assignee: Seiko Epson Corporation (JP)

( * ) Notice: Subject to any disclaimer, the term of this patent is extended or adjusted under 35 U.S.C. 154(b) by 6 days.

(21) Appl. No.: 15/333,528

(22) Filed: Oct. 25, 2016

(65) Prior Publication Data

US 2017/0120584 A1 May 4, 2017

(30) Foreign Application Priority Data

Oct. 29, 2015 (JP) ..... 2015-212866

(51) Int. Cl.
*B41J 2/045* (2006.01)
*B41J 2/14* (2006.01)

(52) U.S. Cl.
CPC ..... *B41J 2/04581* (2013.01); *B41J 2/04541* (2013.01); *B41J 2/04588* (2013.01); *B41J 2/04593* (2013.01); *B41J 2/04596* (2013.01); *B41J 2/14233* (2013.01); *B41J 2002/14491* (2013.01)

(58) Field of Classification Search
CPC .. B41J 2/04581; B41J 2/04548; B41J 2/0455; B41J 2/04588; B41J 2/04501
See application file for complete search history.

(56) References Cited

U.S. PATENT DOCUMENTS

| | | | | |
|---|---|---|---|---|
| 1,854,255 | A | 4/1932 | Green | |
| 9,787,069 | B2 * | 10/2017 | Yoshida | H02G 3/0406 |
| 2003/0146954 | A1 | 8/2003 | Tamura | |
| 2010/0165035 | A1 * | 7/2010 | Komatsu | B41J 2/2142 347/19 |
| 2010/0258333 | A1 * | 10/2010 | Horan | H01B 11/1091 174/78 |

(Continued)

FOREIGN PATENT DOCUMENTS

| | | | |
|---|---|---|---|
| JP | 2003-226006 | A | 8/2003 |
| JP | 2012-206284 | A | 10/2012 |

*Primary Examiner* — Geoffrey Mruk
*Assistant Examiner* — Scott A Richmond
(74) *Attorney, Agent, or Firm* — Harness, Dickey & Pierce, P.L.C.

(57) ABSTRACT

A printing apparatus including a voltage signal generation circuit configured to generate a plurality of voltage signals including a first voltage signal and a second voltage signal; and at least one transmission cable configured to transmit the plurality of voltage signals, the transmission cable including a first tubular conductor including a hollow core and configured to transmit the first voltage signal, a second tubular conductor disposed over an outer circumference of the first tubular conductor with a first insulator between the outer circumference of the first tubular conductor and an inner circumference of the second tubular conductor and being in a constant-voltage applied state, and a third tubular conductor disposed over an outer circumference of the second tubular conductor with a second insulator between the outer circumference of the second tubular conductor and an inner circumference of the third tubular conductor and configured to transmit the second voltage signal.

8 Claims, 6 Drawing Sheets

(56) References Cited

U.S. PATENT DOCUMENTS

| | | | | |
|---|---|---|---|---|
| 2013/0165324 | A1* | 6/2013 | Jang | H01B 12/06<br>505/163 |
| 2014/0155948 | A1* | 6/2014 | Walsh | A61B 5/0084<br>607/6 |
| 2014/0374135 | A1* | 12/2014 | Nagahashi | H01B 9/04<br>174/105 R |
| 2015/0021411 | A1* | 1/2015 | Okui | B41J 2/14233<br>239/102.2 |
| 2015/0197083 | A1* | 7/2015 | Otsuka | B41J 2/04541<br>347/10 |

* cited by examiner

PRINTING APPARATUS AND TRANSMISSION CABLE

The entire disclosure of Japanese Patent Application No. 2015-212866, filed Oct. 29, 2015 is expressly incorporated by reference herein.

BACKGROUND

1. Technical Field

The present invention relates to a printing apparatus provided with transmission cables for transmitting voltage signals to a liquid ejection head, and to the transmission cables.

2. Related Art

Among printers, each being an example of a printing apparatus, there is a printer including a liquid ejection head, a voltage signal generation circuit, and transmission cables and configured such that voltage signals generated by the voltage signal generation circuit are transmitted to the liquid ejection head using the transmission cables, and then are supplied to a plurality of piezoelectric elements included in the liquid ejection head to allow the liquid ejection head to eject liquids so as to allow characters and/or images to be printed on paper or any other printing medium.

In such a printer, it is important that the voltage signals, which are transmitted to the liquid ejection head using the transmission cables, are supplied to the piezoelectric elements without being distorted in the transmission cables. This is because, with the distortions of the transmitted voltage signals, the piezoelectric elements are not properly deformed (contracted and/or elongated), thereby causing the amount of liquid ejected by the deformation of each of the piezoelectric elements to be varied, and as a result, a situation in which correct sizes of dots are not formed on the paper and this formation of incorrect sizes of dots degrades the printing quality may occur. For this reason, there is a printer (a liquid ejection apparatus) in which, in order to realize the transmission of voltage signals (drive signals) whose distortions are reduced, in flexible flat cables (FFC), each being conventionally used as a transmission cable, each of conductors (signal lines) supplied with the respective voltage signals and each of conductors supplied with a constant voltage (a ground signal) are respectively branched into branched voltage-signal conductors and branched constant-voltage conductors, and the branched voltage-signal conductors and the branched constant-voltage conductors are allocated such that the branched voltage-signal conductors and the branched constant-voltage conductors are adjacent to each other (for example, JP-A-2003-226006). Further, there is a printer (a liquid ejection apparatus) in which, in order to realize the transmission of voltage signals (drive signals) the distortions of which are reduced and which are unlikely to be influenced by external disturbances (for example, an electromagnetic wave applied from the outside), coaxial cables are employed, as the transmission cables, in substitution for the flexible flat cables (FFC) (for example, JP-A-2012-206284).

By the way, in a printer configured to allow a carriage that reciprocates to include a liquid ejection head, when the movement distance of the carriage when the carriage reciprocates is increased because of the large width of printing paper or any other reason, the length of each of the transmission cables becomes large in accordance with the increase of the movement distance of the carriage. Thus, in the transmission cables whose lengths have become large, the values of inductance elements and resistance elements of the conductors increase, and as a result, a situation in which distortions are more likely to arise in the voltage signals transmitted in the transmission cables occurs.

In such a situation, since the printer disclosed in JP-A-2003-226006 allows each of the conductors included in the flexible flat cables to be branched into branched conductors so as to reduce the distortions of the voltage signals, a large number of conductors are needed to take measures against the increase of the length of each of the flexible flat cables. As a result, with the increase of the number of the conductors, for example, the flexible flat cables become hard to bend, and this may interfere with the movement of the carriage.

Further, in the printer disclosed in JP-A-2012-206284, one voltage signal (one voltage waveform signal) is transmitted using one coaxial cable (one transmission cable). Thus, in the case where mutually different voltage signals are supplied to a plurality of piezoelectric elements provided in a liquid ejection head to allow the liquid ejection head to eject mutually different kinds of liquids (for example, mutually different colored liquids), coaxial cables whose number is the same as the number of the mutually different voltage signals are needed. Such coaxial cables, however, have a higher rigidity and are harder to bend, as compared with the flexible flat cables. Thus, in such a printer configured to allow a carriage that reciprocates to include a liquid ejection head, when the number of the coaxial cables is increased, that is, when the number of conductors constituting the coaxial cables is increased, for example, a situation in which the coaxial cables, in which the number of the conductors is increased, interfere with the movement of the carriage may occur.

In addition, such a situation is not limited to printers, but is relatively common to printing apparatuses in which voltage signals generated in a voltage signal generation circuit are transmitted to a liquid ejection head from the voltage signal generation circuit using transmission cables, and then are supplied to piezoelectric elements of the liquid ejection head to allow the liquid ejection head to eject liquids.

SUMMARY

An advantage of some aspects of the invention is that a printing apparatus is provided that enables reduction of distortions of voltage signals transmitted to a liquid ejection head using transmission cables without increasing the transmission cables and without increasing conductors included in the transmission cables, and that the transmission cables, included in such a printing apparatus, are provided.

Hereinafter, means provided in such a printing apparatus and transmission cables as well as advantageous effects brought about by the behaviors thereof will be described.

According to a first aspect of the invention, a printing apparatus includes a voltage signal generation circuit, at least one transmission cable, and a liquid ejection head. The voltage signal generation circuit is configured to generate a plurality of voltage signals including a first voltage signal and a second voltage signal. The at least one transmission cable is configured to transmit the plurality of voltage signals, and each of the transmission cable includes a first tubular conductor including a hollow core and configured to transmit the first voltage signal, a second tubular conductor disposed over an outer circumference of the first tubular conductor with a first insulator between the outer circumference of the first tubular conductor and an inner circumference of the second tubular conductor and being in a constant-voltage applied state, and a third tubular conductor disposed over an outer circumference of the second tubular conductor with a second insulator between the outer circumference of the second tubular conductor and an inner circumference of the third tubular conductor and configured to transmit the second voltage signal. Further, the liquid ejection head includes a plurality of piezoelectric elements, and is configured to receive the plurality of voltage signals, transmitted by the at least one transmission cable, and to supply each of at least one specified piezoelectric element among the piezoelectric elements with one of the received voltage signals so as to allow the each of at least one specified piezoelectric element to eject liquid.

This configuration enables reduction of the distortions of the voltage signals, which are transmitted to the liquid ejection head, without increasing the at least one transmission cable and without increasing the conductors included in the at least one transmission cable.

In the above printing apparatus, preferably, the liquid ejection head includes a voltage supply unit configured to selectively supply one of the first voltage signal and the second voltage signal to one electrode of one of the piezoelectric elements, and to supply a constant voltage to the other electrode of the one of the piezoelectric elements.

This configuration enables one of the plurality of voltage signals whose distortions are reduced to be selectively supplied to one of the piezoelectric element PZ, and thereby enables improvement of the printing quality of a printed image.

In the above printing apparatus, preferably, the liquid ejection head includes a voltage supply unit including the plurality of piezoelectric elements including a first piezoelectric element and a second piezoelectric element, and the voltage supply unit is configured to supply the first voltage signal to one electrode of the first piezoelectric element, supply the second voltage signal to one electrode of the second piezoelectric element, and supply a constant voltage to the other electrode of the first piezoelectric element and the other electrode of the second piezoelectric element.

This configuration allows each of the first signal voltage and the second signal voltage to be supplied to a corresponding one of mutually different piezoelectric elements, and thus, enables the first signal voltage and the second signal voltage, which are transmitted by one of the at least one transmission cable, to allow the liquid ejection head to eject two mutually different kinds of liquids.

The above printing apparatus preferably further includes a constant voltage generation circuit configured to generate a constant voltage that is the same as the above constant voltage.

This configuration enables the second tubular conductor, which is in a state in which the generated constant voltage is applied, to bring a balance of an electric property to each of the first tubular conductor, which transmits the first voltage signal, and the third tubular conductor, which transmits the second voltage signal.

In the above printing apparatus, preferably, a signal waveform of the first voltage signal, transmitted by each of the at least one transmission cable, and a signal waveform of the second voltage signal, transmitted by the each of the at least one transmission cable, are different from each other.

This configuration enables, when printing is performed, a plurality of mutually different sized dots to be formed by the plurality of voltage signals, which are transmitted to the liquid ejection head and include a plurality of mutually different waveforms (for example, two mutually different waveforms, one being for use in forming a large size dot, the other one being for use in forming a small size dot).

In the above printing apparatus, preferably, a maximum value among values of gradients included in the signal waveform of the first voltage signal is larger than a maximum value among values of gradients included in the signal waveform of the second voltage signal.

This configuration allows the first voltage signal, having a signal waveform whose gradient is large, that is, having a large voltage-change ratio, to be transmitted using the transmission cable, that is, the first tubular conductor, disposed at the inner side of the second tubular conductor, which is in a constant-voltage applied state, and thus, reduces an influence applied from the outside on the voltage change.

In the above printing apparatus, preferably, the at least one transmission cable includes a plurality of transmission cables, and the plurality of transmission cables are provided in a mutually parallel state.

This configuration realizes the disposition of the plurality of transmission cables in a state in which mutual influences of crosstalk on the individual transmission cables are reduced and integrally bending of the transmission cables is facilitated.

According to a second aspect of the invention, a transmission cable is configured to transmit a plurality of voltage signals including a first signal and a second signal and generated by a voltage signal generation circuit to a liquid ejection circuit including a plurality of piezoelectric elements and configured to supply each of at least one specified piezoelectric element among the piezoelectric elements with one of the voltage signals so as to allow the each of at least one specified piezoelectric element to eject liquid. Further, the transmission cable includes a first tubular conductor including a hollow core and configured to transmit the first voltage signal, a second tubular conductor disposed over an outer circumference of the first tubular conductor with a first insulator between the outer circumference of the first tubular conductor and an inner circumference of the second tubular conductor and being in a constant-voltage applied state, and a third tubular conductor disposed over an outer circumference of the second tubular conductor with a second insulator between the outer circumference of the second tubular conductor and an inner circumference of the third tubular conductor and configured to transmit the second voltage signal.

This configuration enables transmission of the plurality of voltage signals to the liquid ejection head in a state in which the distortions of the voltage signals are reduced without increasing the transmission cable and without increasing the conductors included in the transmission cable.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the printing apparatus will be described with reference to the drawings.

Figure 1:
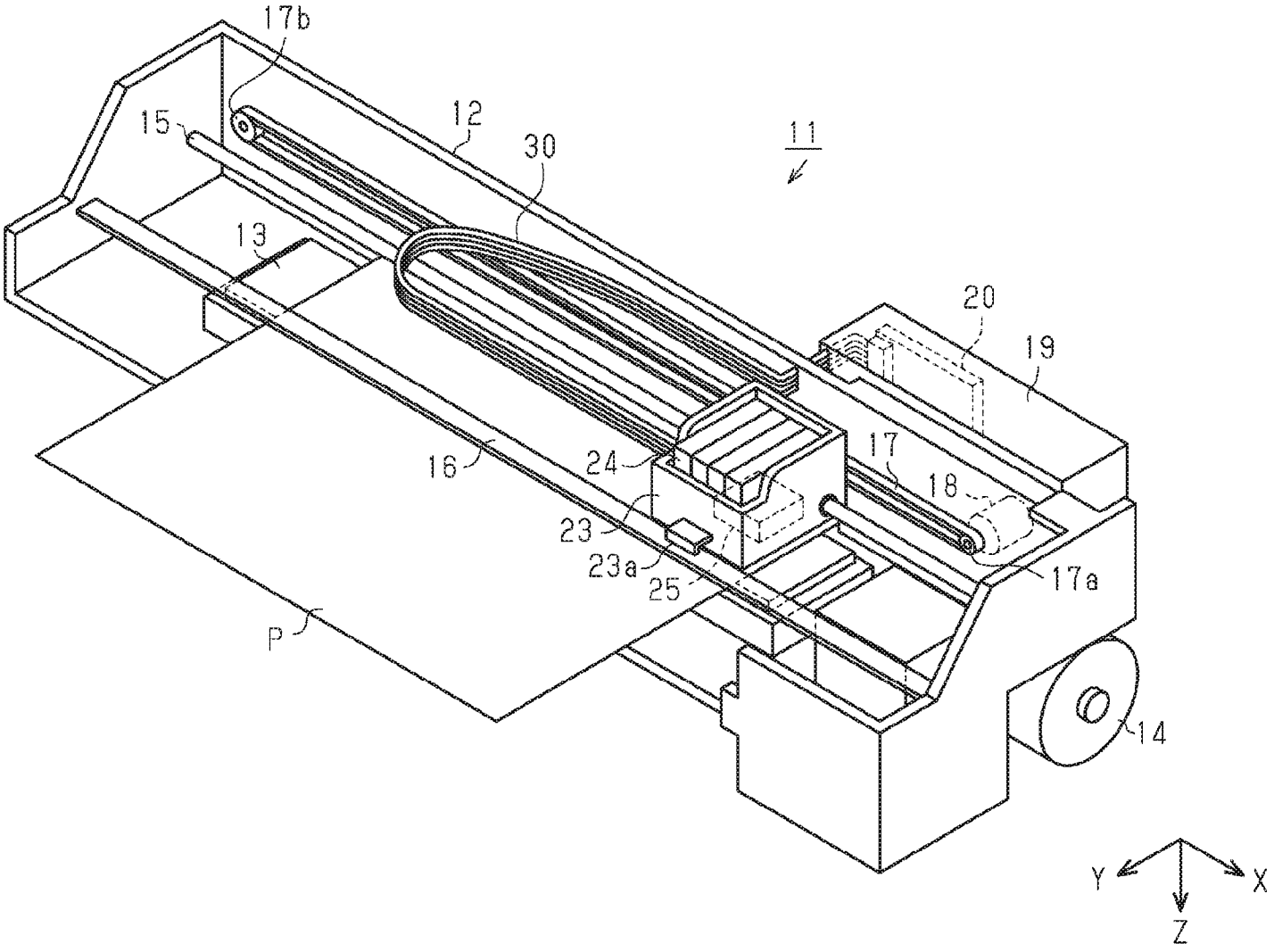
FIG. 1 is a perspective view of a printer, an embodiment of a printing apparatus according to the invention, schematically illustrating an exemplary configuration of the printer.

As shown in FIG. 1, a printing apparatus 11 is an ink jet printer that allows a liquid ejection head 25 to eject inks, each of which is an example of a liquid, onto paper P, which is an example of a medium, to execute printing processing (recording processing). In this embodiment, when the printing processing is executed, the paper P is transported in one direction, and is subjected to a printing process at a position facing the liquid ejection head 25. This direction in which the paper P is transported will be hereinafter referred to as a transport direction Y, and a direction perpendicular to the direction Y and along the width direction of the paper P will be hereinafter referred to as a scan direction X. That is, the scan direction X and the transport direction Y are directions intersecting with each other (preferably, perpendicular to each other), and, in this embodiment, each of the scan direction X and the transport direction Y is a direction intersecting with a gravity direction Z (preferably, perpendicular to the gravity direction Z).

In the printing apparatus 11, a frame 12 is provided, and this frame 12 has an approximately rectangular box shape. In a lower portion inside the frame 12, a medium supporting table 13 is disposed so as to allow its long-length direction to extend in the scan direction X, and in a portion below the frame 12, a paper feeding motor 14 is disposed. Further, a transport mechanism (not illustrated) driven by the paper feeding motor 14 transports the paper P in the transport direction Y so as to allow the paper P to pass on the medium supporting table 13.

Further, a carriage 23 is disposed so as to be movable above the paper P, transported on the medium supporting table 13, in a direction intersecting with the transport direction Y. Further, in a portion inside the frame 12 and above the medium supporting table 13, a guide shaft 15 and a guide plate 16 are disposed so as to cross between the both lateral sides of the frame 12. The guide shaft 15 has a shaft line extending in the scan direction X, in which the long-length direction of the medium supporting table 13 extends. The guide plate 16 is provided with an elongate and flat face having a constant width and extending in the scan direction X.

The guide shaft 15 is a columnar or cylindrical shaped shaft, and is inserted in a support hole formed in the carriage 23 and located at a side opposite the transport direction Y side of the carriage 23 so as to penetrate the carriage 23 in the scan direction X. Further, the guide plate 16 is disposed so as to support a protruding portion 23*a* from the below. The protruding portion 23*a* is formed so as to protrude from the transport direction Y side of the carriage 23. The carriage 23, therefore, is guided in a state of being supported by the guide shaft 15 and the guide plate 16, and is reciprocatable above a printing face of the paper P in the scan direction X.

A driving pulley 17*a* and a driven pulley 17*b* are respectively supported at a position adjacent to one end of the guide shaft 15 and a position adjacent to the other end of the guide shaft 15 so as to be rotatable. The driving pulley 17*a* is coupled to an output shaft of a carriage motor 18, and an endless timing belt 17 is hung and wound between the driving pulley 17*a* and the driven pulley 17*b*. Further, part of the endless timing belt 17 is coupled to the carriage 23. Accordingly, the drive of the carriage motor 18 allows the carriage 23 to reciprocate in the scan direction X via the timing belt 17 while being guided by the guide shaft 15 and the guide plate 16.

Further, the liquid ejection head 25, which ejects inks onto the paper P to perform printing, is attached to the gravidity direction Z side of the carriage 23, which reciprocates. Further, ink cartridges 24 are attached to the carriage 23, and these cartridges 24 contain inks to be supplied to the liquid ejection head 25. In this embodiment, four ink cartridges 24 each containing a corresponding one of four kinds of inks (for example, inks in four colors, such as cyan, magenta, yellow, and black).

Figure 2:
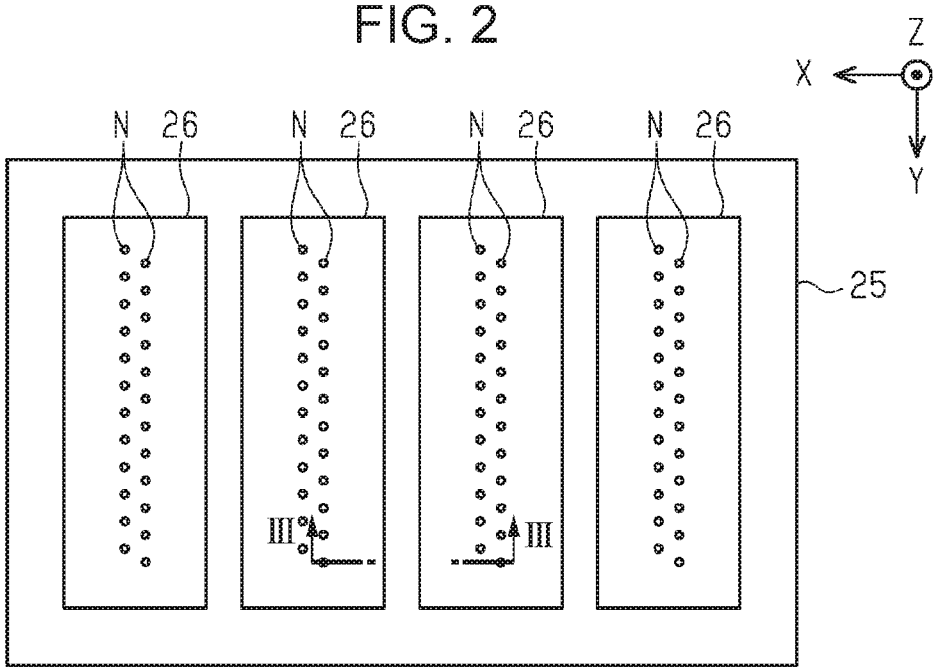
FIG. 2 is a plan view of a liquid ejection head illustrating nozzles which are disposed in the liquid ejection head and through which liquids are ejected.

As shown in FIG. 2, in the liquid ejection head 25, four head units 26 are arranged in the scan direction X so as to be each associated with a corresponding one of the four ink cartridges 24. Each of the head units 26 includes a plurality of nozzles N. Theses nozzles N are arranged in the transport direction Y so as to form rows (two rows in this embodiment), and through the nozzles N, the inks are ejected.

Figure 3:
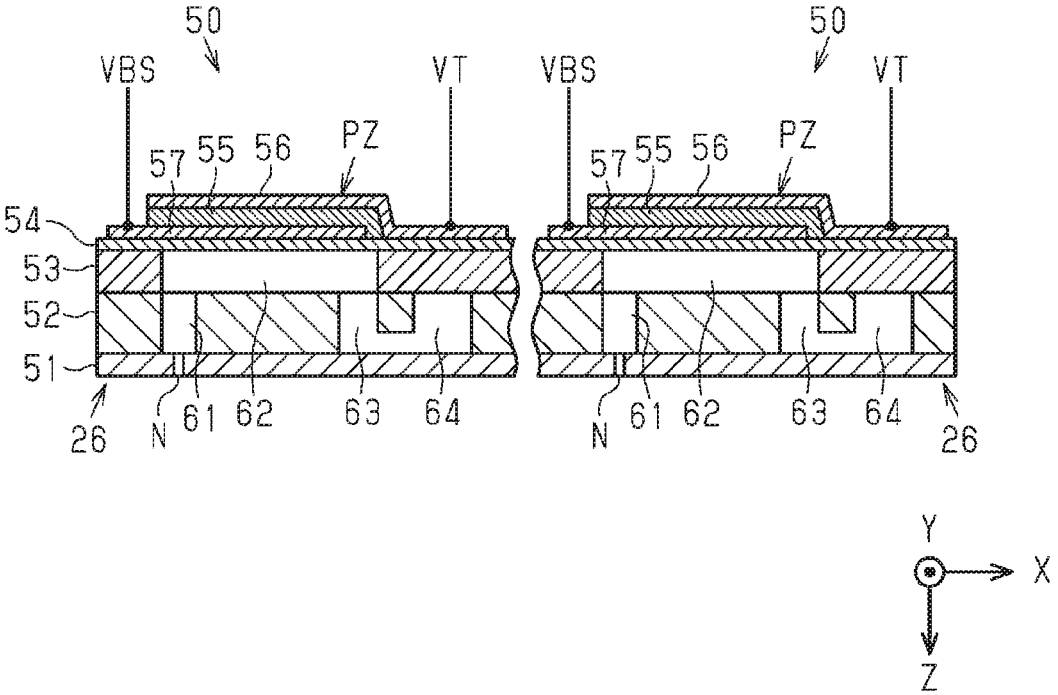
FIG. 3 is a cross-sectional view of an ejection mechanism for ejecting liquids taken along the line III-III of FIG. 2 and illustrating the configuration of the ejection mechanism.

As shown in FIG. 3, each of the head units 26 includes an ejection mechanism 50, and this ejection mechanisms 50 serves as a mechanism for allowing the ink to be ejected through the individual nozzles N. The ejection mechanism 50 is a structure including, in order from the gravity direction Z side thereof, a nozzle plate 51, in which the plurality of nozzles N are formed, a flow path substrate 52, a pressure chamber substrate 53, and a vibration plate 54, these plates and substrates being fixed to one another in a lamination state. The ejection mechanism 50, having such a structure, includes nozzle communication chambers 61, pressure chambers 62, ink supply paths 63, and common ink-chambers 64. Each of the nozzle communication chambers 61 communicates with a corresponding one of the nozzles N. Each of the pressure chambers 62 communicates with a corresponding one of the nozzle communication chambers 61. Each of the ink supply paths 63 communicates with a corresponding one of the pressure chambers 62. Each of the common ink-chambers 64 communicates with a corresponding one of the ink supply paths 63. Among these elements, each of the nozzle communication chambers 61, each of the pressure chambers 62, and each of the nozzle supply paths 63 are formed so as to be associated with a corresponding one of the nozzles N. Further, in one of the head units 26, the common ink-chambers 64 are formed so as to be continuous across all of the plurality of nozzles N (that is, so as to communicate with one another among all of the nozzles N) to allow the same kind of ink to be supplied to all of the nozzles N.

The vibration plate 54 is an elastically-vibratable and flat-plate-shaped member. Each of the piezoelectric elements PZ, which are examples of actuators, is disposed on a plate face of the vibration plate 54 at a side opposite the side of a corresponding one of the pressure chambers 62. Each of the piezoelectric elements PZ includes a piezoelectric substance 55, and this piezoelectric substance 55 is elongated or contracted by being supplied with a voltage. Further, each of the piezoelectric elements PZ includes a first electrode 56 (one electrode) and a second electrode 57 (the other electrode). The first electrode 56 and the second electrode 57 are disposed at the both sides of the piezoelectric substance 55 in the gravity direction Z so as to interpose the piezoelectric substance 55 therebetween.

The first electrode 56 is a separate electrode that is formed so as to be associated with each of the pressure chambers 62. The second electrode 57 is an electrode that is formed on the plate face of the vibration plate 54 and that is common to the plurality of piezoelectric elements PZ, each disposed so as to be associated with a corresponding one of the plurality of pressure chambers 62.

In this embodiment, the first electrode 56 is supplied with an output voltage VT, and the second electrode 57 is supplied with a constant voltage VBS. The output voltage VT is a voltage in accordance with the amount of an ink to be ejected through a corresponding nozzle N; while the constant voltage VBS is a constant voltage. The supply of these voltages causes mainly a portion sandwiched by the first electrode 56 and the second electrode 57 in the piezoelectric substrate 55 to contract (or elongate) along the plate face of the vibration plate 54 in accordance with the differential voltage between the supplied voltages, that is, the output voltage VT and the constant voltage VBS, and this contraction (or elongation) causes the vibration plate 54 to bend. Further, this bending of the vibration plate 54 compresses the ink contained inside a corresponding pressure chamber 62 so as to cause the ink to be ejected through a corresponding nozzle N. In this way, the piezoelectric elements PZ serve as actuators.

Let us return to FIG. 1. The printing apparatus 11 includes a container portion 19 inside the frame 12, and a main-substrate 20 is contained in this container portion 19. The main-substrate 20 generates signals for controlling the operation of the printing apparatus 11, such as operation of ejecting ink. Further, a transmission cable 30 is disposed so as to couple the main-substrate 20, which is contained in the container portion 19, to the liquid ejection head 25, which is attached to the carriage 23. In this embodiment, four transmission cables 30 each associated with a corresponding one of the four head units 26 are provided in a mutually parallel state in the gravity direction Z.

In each of the four transmission cables 30, voltage signals needed for allowing the ink to be ejected from a corresponding one of the head units 26 are transmitted to the liquid ejection head 25 from the main-substrate 20. Further, in each of the head units 26 of the liquid ejection head 25, voltage signals selected from the transmitted voltage signals serve as the output voltage signals VT and are supplied to specified first electrodes 56 among the first electrodes 56 corresponding to the relevant head unit 26.

Next, voltage signals, which are generated by the main-substrate 20, and the output signals VT, which are output to specified piezoelectric elements PZ, will be described. In addition, in this embodiment, the generations of the transmitted voltage signals and the outputs of the output voltages VT to specified piezoelectric elements PZ in the respective four head units 26, arranged in the liquid election head 25, are performed in circuits having the same configuration. Thus, one head unit 26 on behalf of the four head units 26 will be described below herein.

Figure 4:
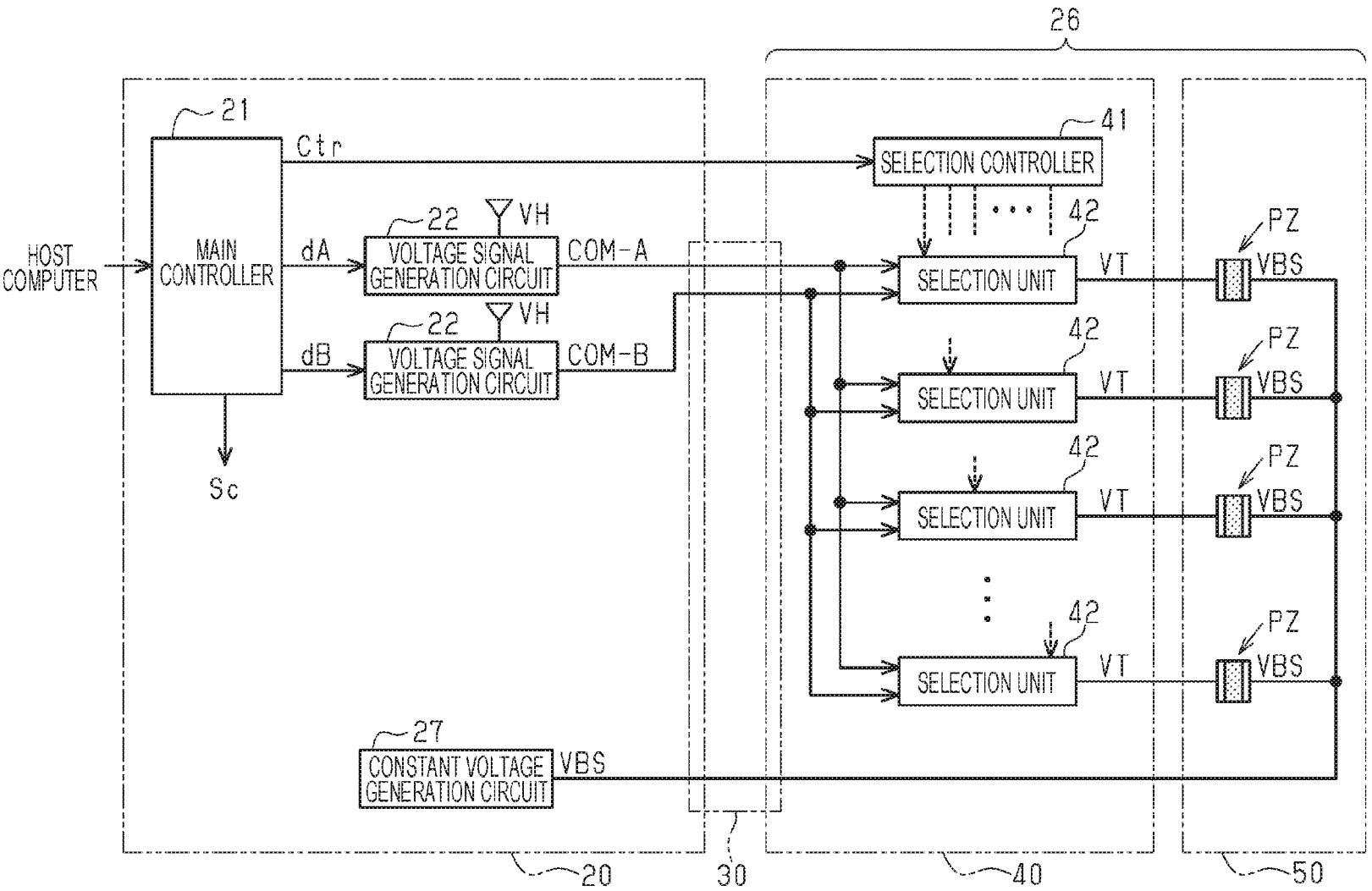
FIG. 4 is a block diagram illustrating the configuration of a circuit for generating voltage signals to be supplied to piezoelectric elements and the configuration of a circuit for supplying the voltage signals to the piezoelectric elements.

As shown in FIG. 4, in the main-substrate 20, a main controller 21, two voltage signal generation circuits 22, and a constant voltage generation circuits 27 are disposed. Further, in the liquid ejection head 25, an electric circuit including a voltage supply unit 40 is disposed on a sub-substrate (not illustrated) provided in each of the head units 26. This voltage supply unit 40 outputs the output voltages VT to specified first electrodes among the first electrodes 56 of the piezoelectric elements PZ.

The main controller 21 is provided with a microcomputer constituted of a CPU, RAM, ROM, and any other component, and executes a predetermined program upon receipt of image data in relation to a printing target image from a host computer or any other device to output various control signals for controlling circuits included in the voltage signal generation circuits 22, the voltage supply unit 40, and any other circuit unit, and any other kind of signal.

Specifically, the main controller 21 repeatedly supplies digital data dA to one of the voltage signal generation circuits 22, and similarly, repeatedly supplies digital data dB to the other one of the voltage signal generation circuits 22. Here, the data dA defines a signal waveform of a first voltage signal to be supplied to the head unit 26, and the data dB defines a signal waveform of a second voltage signal to be supplied to the head unit 26.

The one of the voltage signal generation circuits 22 converts the repeatedly supplied data dA into an analog voltage, amplifies the analog voltage using, for example, D-class amplification to obtain the first voltage signal, and outputs a voltage signal COM-A, which is an example of the first voltage, to the head unit 26. Similarly, the other one of the voltage generation circuits 22 converts the repeatedly supplied data dB into an analog voltage, amplifies the analog voltage using, for example, D-class amplification to obtain the second voltage signal, and outputs a voltage signal COM-B, which is an example of the second voltage, to the head unit 26. In addition, differences on the two voltage signal generation circuits 22 are just a difference in waveform between two kinds of data input thereto and a difference in waveform between two kinds of voltage signals output therefrom, and the circuits of the two voltage signal generation circuits 22 has the same configuration using a voltage VH, serving as a power source.

Further, the main controller 21 outputs a control signal Sc for controlling the drives of the carriage motor 18 and the paper feeding motor 14, and controlling the movement of the carriage 23 and the transport of the paper P, and further outputs various control signals Ctr to the head unit 26 in synchronization with the control signal Sc. In addition, the control signals Ctr, which are output to the head unit 26, include various kinds of data and signals, such as printing data that defines the amount of ink to be ejected through each of the nozzles N, a clock signal for use in transferring the printing data, timing signals that define a printing cycle and any other time interval.

The voltage supply unit 40, disposed in the head unit 26, includes a selection controller 41 and selection units 42 each associated with a corresponding one of the piezoelectric elements PZ. Further, the voltage supply unit 40 selectively supplies one of the voltage signal COM-A, which is an example of the first voltage signal, and the voltage signal COM-B, which is an example of the second voltage signal, to the first electrode 56 of one of the piezoelectric elements PZ, and supplies a constant voltage to the second electrode 57 of the one of the piezoelectric elements PZ.

Specifically, the selection controller 41 stores therein once pieces of printing data which are output from the main controller 21 in synchronization with the clock signal, and the number of which is equal to the number of the nozzles N (i.e., the number of the piezoelectric elements PZ) included in the head unit 26. Further, the selection controller 41 instructs, in accordance with the stored pieces of printing data, the selection of one the voltage signals COM-A and COM-B at each of the beginnings of an anterior half and a posterior half of the printing cycle, which are defined by one of the timing signals, to each of the selection units 42. Each of the selection units 42 selects one of the voltage signals COM-A and COM-B (or selects none of the voltage signals COM-A and COM-B), and outputs the selected voltage signal, which serves as the output signal VT, to the first electrode 56 of a corresponding one of the piezoelectric elements PZ. In this way, the voltage supply unit 40 supplies the output voltage VT to the first electrode 56 of each of the piezoelectric elements PZ.

Meanwhile, the constant voltage generation circuit 27, which is disposed on the main-substrate 20, generates and outputs the constant voltage VBS to one of the transmission cables 30. Afterward, the constant voltage VBS, having been output from the main-substrate 20, is transmitted to the voltage supply unit 40, which is disposed in the head unit 26 of the liquid ejection head 25, via the one of the transmission cables 30, and is output to the second electrodes 57 of the plurality of piezoelectric elements PZ, which are included in the ejection mechanism 50 of the liquid ejection head 25. In other words, the voltage supply unit 40 supplies the constant voltage VBS to the second electrodes 57 of the piezoelectric elements PZ. As a result, the second electrode 57 of each of the piezoelectric elements PZ is in a constant-voltage applied state.

In this way, each of the piezoelectric elements PZ is selectively supplied with a voltage signal. This selective supply of the voltage signal causes the each of the piezoelectric elements PZ to elongate and contract in accordance with the differential electric potential (voltage difference) between the output voltage VT, which is supplied to the first electrode 56, and the constant voltage VBS, which is supplied to the second electrode 57, and this elongation and contraction cause the ink to be ejected through each of the nozzles N. Further, in accordance with the amount of the relevant ink having been ejected, one of several kinds of dots having mutually different sizes is formed on the paper P.

In this embodiment, the main controller 21 controls the supply of the voltage signal to one piezoelectric element PZ to allow the ink to be ejected through a corresponding nozzle N twice at a maximum during one printing cycle so as to allow one of three kinds of dots having mutually different sizes, that is, a large size dot, a middle size dot, and a small size dot, to be formed on the paper P. Naturally, the main controller 21 also controls the supply of the voltage signal to one piezoelectric element PZ so as not to allow any dot to be formed on the paper P, that is, so as not to allow the ink to be ejected through a corresponding nozzle N during the one printing cycle.

In this embodiment, the voltage signal COM-A and the voltage signal COM-B, which are two kinds of voltage signals for use in forming the dots having mutually different sizes, are generated by the voltage signal generation circuits 22. Here, the voltage signal COM-A and the voltage signal COM-B, which are generated by the voltage signal generation circuits 22, will be described below. It is to be noted that the voltage signals COM-A and COM-B, described below, are just examples. Actually, it is preferable that voltage signals having signal waveforms suitable for the property of the paper P (medium), the transport speed, and any other factor influencing printing quality are generated by combining various voltage waveforms.

Figure 5:
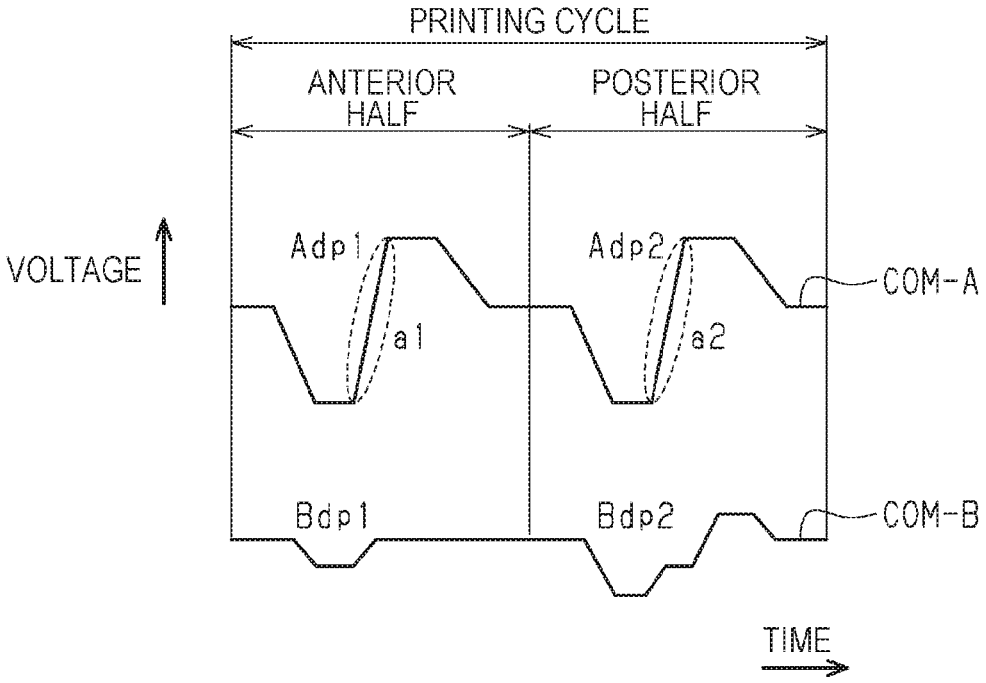
FIG. 5 is a waveform diagram illustrating the signal waveforms of voltage signals to be supplied to piezoelectric elements.

As shown in FIG. 5, the waveform of the voltage signal COM-A is formed of two successive waveforms, that is, a trapezoidal shaped waveform Adp1 and a trapezoidal shaped waveform Adp2. The trapezoidal shaped waveform Adp1 and the trapezoidal shaped waveform Adp2 are respectively disposed in the anterior half and the posterior half of one printing cycle. In this embodiment, the trapezoidal shaped waveform Adp1 and the trapezoidal shaped waveform Adp2 have approximately the same waveform, and each of the waveforms Adp1 and Adp2 is a waveform that, when supplied to the first electrode 56 of one of the piezoelectric elements PZ, indicates a voltage change that allows ink having a middle amount to be ejected through a nozzle N corresponding to the relevant piezoelectric element PZ.

The waveform of the voltage signal COM-B is formed of two successive waveforms, that is, a trapezoidal shaped waveform Bdp1 and a trapezoidal shaped waveform Bdp2. The trapezoidal shaped waveform Bdp1 and the trapezoidal shaped waveform Bdp2 are respectively disposed in the anterior half and the posterior half of one printing cycle. In this embodiment, the trapezoidal shaped waveform Bdp1 and the trapezoidal shaped waveform Bdp2 are waveforms different from each other. The trapezoidal shaped waveform Bdp1 among these waveforms is a waveform that allows ink in the vicinity of a relevant nozzle N to slightly vibrate to prevent the increase the viscosity of the ink. That is, the trapezoidal shaped waveform Bdp1 is a voltage waveform that, when supplied to a first electrode 56 of one of the piezoelectric elements PZ, indicates a voltage change that does not allow any ink (any ink droplet) to be ejected through a nozzle N corresponding to the relevant piezoelectric element PZ. Further, the trapezoidal shaped waveform Bdp2 is a voltage waveform that, when supplied to a first electrode 56 of one of the piezoelectric elements PZ, indicates a voltage change that allows ink having a small amount to be ejected through a nozzle N corresponding to the relevant piezoelectric element PZ. In this case, the small amount of the ejected ink is smaller than the middle amount of ink ejected when the trapezoidal shaped waveform Adp1 or the trapezoidal shaped waveform Adp2 is supplied to the first electrode 56.

Accordingly, when, among the mutually different size dots, for example, the large size dot has been specified to be formed, the selection controller 41 controls a relevant selection unit 42 so as to allow the selection unit 42 to respectively select the trapezoidal shaped waveform Adp1 and the trapezoidal shaped waveform Adp2 of the voltage signal COM-A in the anterior half and the posterior half of one printing cycle. With this control, ink having a middle amount is ejected twice through a nozzle N corresponding to a piezoelectric element PZ including a first electrode 56 to which the trapezoidal shaped waveform Adp1 and the trapezoidal shaped waveform Adp2 have been supplied, and thus, a large size dot resulting from combining two landed droplets of the ejected ink is formed on the paper P.

Further, when the middle size dot has been specified to be formed, the selection controller 41 controls a relevant selection unit 42 so as to allow the selection unit 42 to respectively select the voltage signal COM-A (the trapezoidal shaped waveform Adp1) and the voltage signal COM-B (the trapezoidal shaped waveform Bdp2) in the anterior half and the posterior half of one printing cycle. With this control, ink having a middle amount and ink having a small amount are ejected through a nozzle N corresponding to a piezoelectric element PZ including a first electrode 56 to which the trapezoidal shaped waveform Adp1 and the trapezoidal shaped waveform Bdp2 have been supplied, and thus, a middle size dot resulting from combining two landed droplets of the ejected ink is formed on the paper P.

Meanwhile, when the small size dot has been specified to be formed, the selection controller 41 controls a relevant selection unit 42 so as to allow the selection unit 42 to select none of the voltage signals COM-A and COM-B in the anterior half of one printing cycle, and select the voltage signal COM-B (the trapezoidal shaped waveform Bdp2) in the posterior half of the one printing cycle. With this control, ink having a small amount is ejected once through a nozzle N corresponding to a piezoelectric element PZ including a first electrode 56 to which the trapezoidal shaped waveform Bdp2 has been supplied, and thus, a small size dot is formed on the paper P.

In addition, when no dot has been specified to be formed, the selection controller 41 controls a relevant selection unit 42 so as to allow the selection unit 42 to, for example, select the voltage signal COM-B (the trapezoidal shaped waveform Bdp1) in the anterior half of one printing cycle, and select none of the voltage signals COM-A and COM-B in the posterior half of the one printing cycle. With this control, in a nozzle N corresponding to a piezoelectric element PZ including a first electrode 56 to which the trapezoidal shaped waveform Bdp1 has been supplied, ink in the vicinity of the nozzle N is just slightly vibrated and no ink is ejected, and thus, no dot is formed on the paper P and the paper P remains in a non-printed state.

In addition, in this embodiment, a maximum value among the values of gradients included in the waveform of the voltage signal COM-A, that is, a value of the gradient of a voltage rising portion a1 of the trapezoidal shaped waveform Adp1 or a value of the gradient of a voltage rising portion a2 of the trapezoidal shaped waveform Adp2 is larger than a maximum value among the values of gradients included in the waveform of the voltage signal COM-B.

By the way, in this embodiment, through one transmission cable 30, the voltage signal COM-A, the voltage signal COM-B, and the constant voltage VBS are transmitted from the main-substrate 20 to the liquid ejection head 25 (the voltage supply unit 40 of the head unit 26). The configuration of this transmission cable 30 will be described below.

Figure 6:
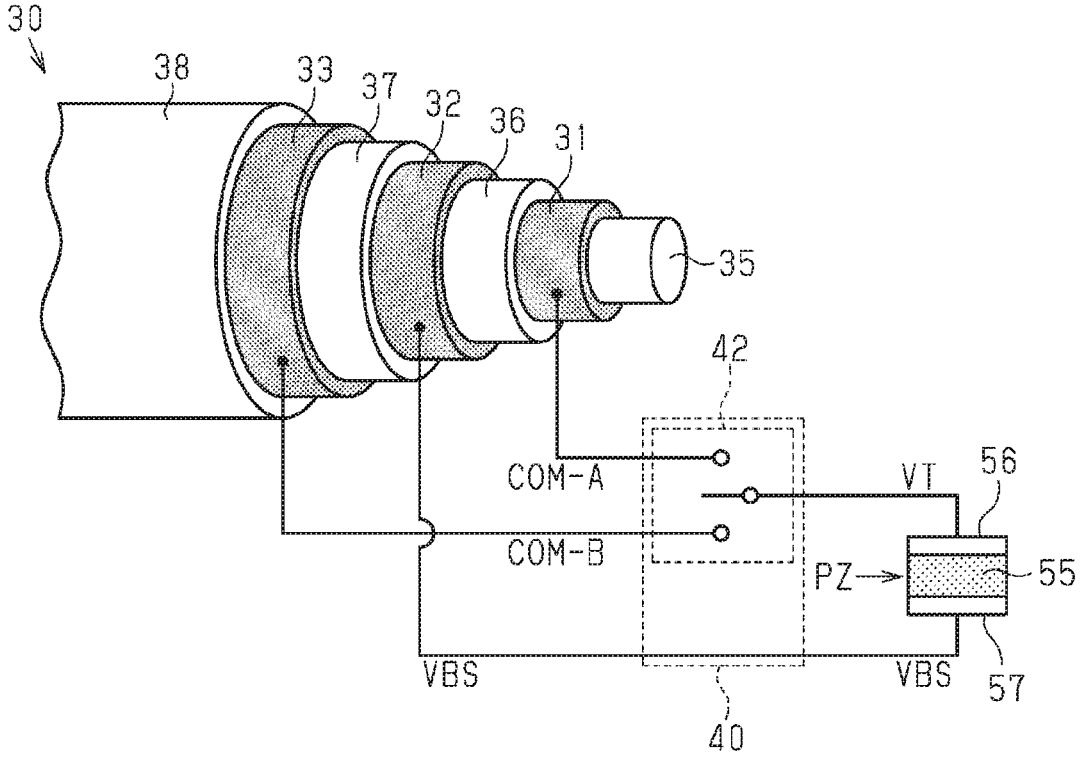
FIG. 6 is a configuration diagram illustrating the structure of a transmission cable according to an embodiment of the invention and including tubular conductors of three layers, and a configuration in which voltage signals each transmitted by a corresponding one of the tubular conductors are supplied to a piezoelectric element.

As shown in FIG. 6, the one transmission cable 30 includes a first tubular conductor 31, a second tubular conductor 32, and a third tubular conductor 33. Further, the transmission cable 30 includes a first insulator 36 and a second insulator 32. The first tubular conductor 31 includes a hollow core. The second tubular core 32 is disposed over the outer circumference of the first tubular conductor 31, and the first insulator 36 is interposed between the outer circumference of the first tubular conductor 31 and the inner circumference of the second tubular conductor 32. The third tubular core 33 is disposed over the outer circumference of the second tubular conductor 32, and the second insulator 37 is interposed between the outer circumference of the second tubular conductor 33 and the inner circumference of the third tubular conductor 33. In addition, in this embodiment, a columnar insulator 35 is inserted in the hollow core of the first tubular conductor 31 so that the tubular shape of the first tubular conductor 31 is not deformed. Further, an outer coating layer 38 covers the outer circumference of the third tubular conductor 33. Further, the individual tubular conductors have approximately cylindrical shapes having concentric axes, and are each formed of a conductive metal plate (including a thin plate or foil) or a metallic braided wire assembly. Accordingly, the transmission cable 30 includes three tubular conductor layers, and is a so-called coaxial cable including three conductors.

In this embodiment, the transmission cable 30, configured in such a manner as described above, is coupled to the voltage signal generation circuits 22 so as to allow the voltage signal COM-A to be transmitted by the first tubular conductor 31, and allow the voltage signal COM-B to be transmitted by the third tubular conductor 33. Further, the transmission cable 30 is coupled to the constant voltage generation circuit 27 so as to allow the constant voltage VBS to be transmitted by the second tubular conductor 32. Thus, in the transmission cable 30, the first tubular conductor 31 and the third tubular conductor 33 are each in a state in which the voltage varies, and the second tubular conductor 32 is in a state in which a constant voltage is applied.

As shown in FIG. 6, the voltage signals, which are transmitted by the respective tubular conductors in such a manner as described above, are output to the voltage supply unit 40 (the selection units 42), and thereafter, the output voltage VT, having a voltage waveform having been selected in accordance with a relevant piece of printing data, and the constant voltage VBS are output to a relevant piezoelectric element PZ. Further, the output voltage VT and the constant voltage VBS, having been output to the relevant piezoelectric elements PZ, are respectively supplied to the first electrode 56 and the second electrode 57, which are included in the relevant piezoelectric elements PZ.

Next, the behavior of the printing apparatus 11, according to this embodiment, will be described.

In this embodiment, one of the transmission cables 30 transmits the two voltage signals COM-A and COM-B to the liquid ejection head 25 using one coaxial cable. That is, in this embodiment, one transmission cable 30 transmits the two voltage signals COM-A and COM-B using one coaxial cable; while, in a conventional configuration, the two voltage signals COM-A and COM-B are transmitted using two coaxial cables: one being a single coaxial cable for transmitting the voltage signal COM-A, the other one being a single coaxial cable for transmitting the voltage signal COM-B. In other words, in the two coaxial cables in the conventional configuration, the total number of the conductors is four; while, in the one coaxial cable in this embodiment, the total number of the conductors is three. Thus, the reduction of the number of the conductors is realized.

Further, the transmission cable 30 in this embodiment has a behavior of reducing the distortion of the signal waveform of each of the voltage signals COM-A and COM-B, transmitted to the liquid ejection head 25. This behavior of reducing the waveform distortion will be described with reference to the drawing.

Figure 7:
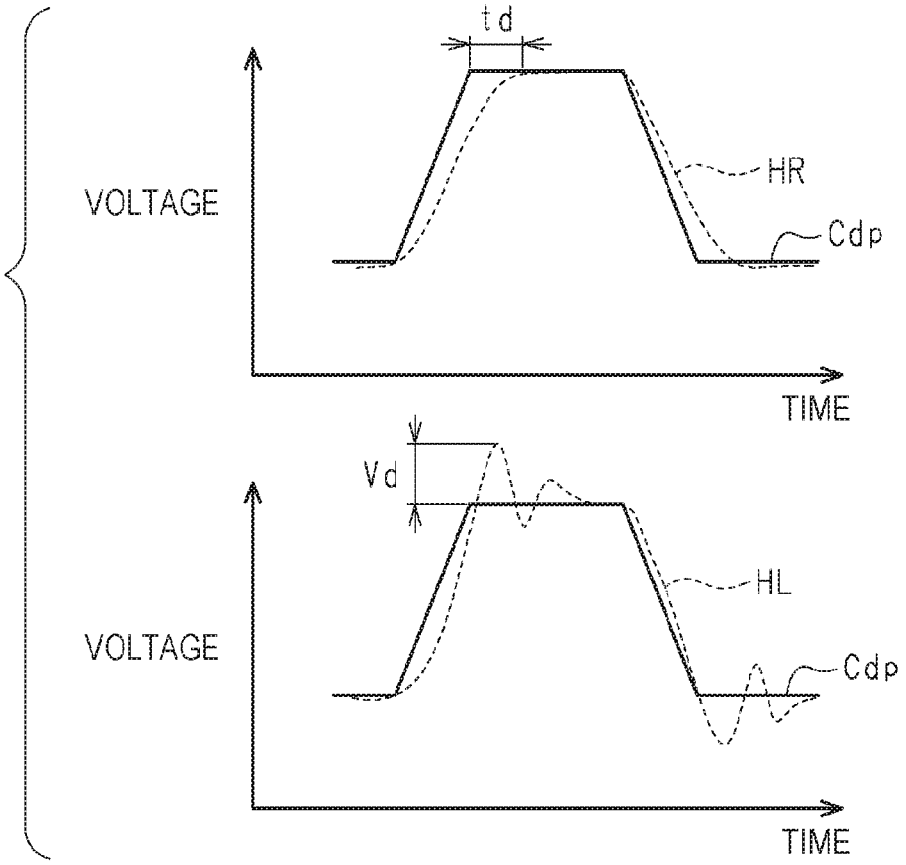
FIG. 7 illustrates a diagram illustrating the influence of a resistance element of a transmission cable on a voltage signal, and a diagram illustrating the influence of an inductance element of the transmission cable on the voltage signal.

When a voltage signal having a trapezoidal waveform Cdp, shown in a full line in FIG. 7, is transmitted via a conductor (a tubular conductor) of the transmission cable 30, a distortion due to the resistance and the inductance of the transmission cable 30 occurs in the signal waveform of a post-transmission voltage signal, a voltage signal after transmission through the transmission cable 30, relative to the signal waveform of a pre-transmission voltage signal.

That is, as shown by a waveform HR represented in a dashed line of the upper figure in FIG. 7, the trapezoidal waveform Cdp of the pre-transmission voltage signal is subjected to a distortion having a transmission delay time td caused by a voltage reduction due to the resistance element of the conductor (the tubular conductor) of the transmission cable 30. Such an occurrence of the delay time td in the transmission of the voltage signal causes the timing of the elongation/contraction of a relevant piezoelectric element PZ to be delayed, and as a result, the timing of the ejection of ink through a nozzle N corresponding to the piezoelectric element PZ is delayed. Further, as shown by a waveform HL represented in a dashed line of the lower figure in FIG. 7, the trapezoidal waveform Cdp of the pre-transmission voltage signal is subjected to a distortion having a voltage fluctuation caused by an induced electromotive force due to the inductance element of the conductor (the tubular conductor) of the transmission cable 30. Further, if, as shown in FIG. 7, an increased voltage Vd due to the induced electromotive force occurs in the voltage signal, and this increased voltage Vd causes the maximum voltage value of the voltage signal to exceed the withstand voltage value of the circuit of the voltage supply unit 40, a situation in which the circuit does not normally operate may occur. Further, in the case where a voltage signal having such an increased voltage value (or a decreased voltage value) is supplied to a relevant piezoelectric element PZ, the voltage signal causes the amount of ink ejected through a nozzle N corresponding to the piezoelectric element PZ to be changed, and as a result, the size of a dot formed on the paper P is changed.

In contrast thereto, the transmission cable 30, which is a coaxial cable including three concentric, tubular conductors in this embodiment, enables reduction of the waveform distortion occurring in the signal waveform of the voltage signal by allowing the values of the resistance element and the inductance element of each of the tubular conductors to be adjusted. Hereinafter, the adjustment of the values of the resistance element and the inductance element of each of the tubular conductors included in the transmission cable 30 will be describe with reference to the drawing.

Figure 8:
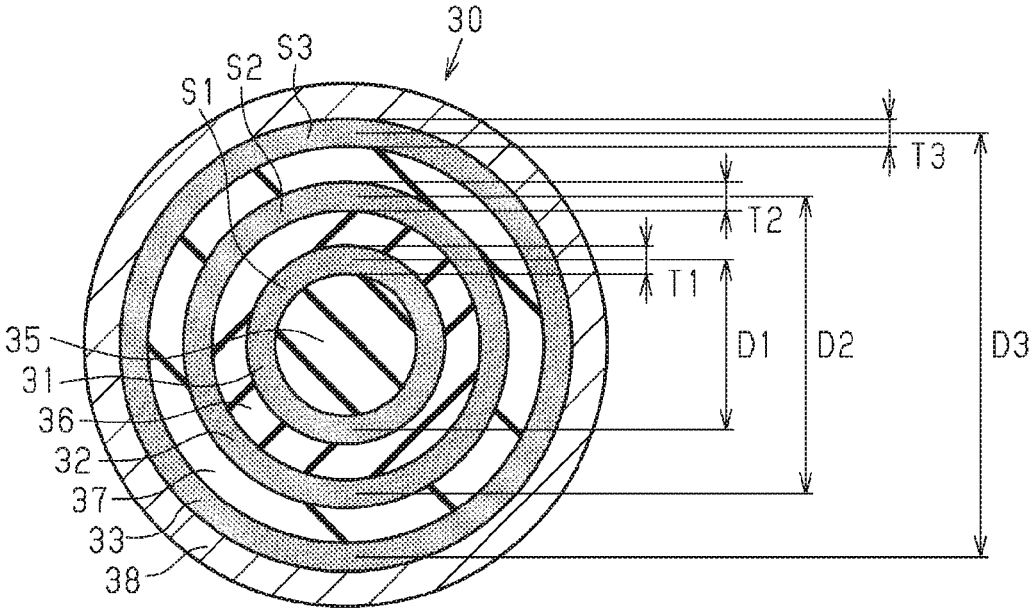
FIG. 8 is a cross-sectional view of a transmission cable.

As shown in FIG. 8, in the transmission cable 30, it is supposed that a circle drawn by the center of the thickness of the conductor layer of the first tubular conductor 31 has a diameter D1; a circle drawn by the center of the thickness of the conductor layer of the second tubular conductor 32 has a diameter D2; and a circle drawn by the center of the thickness of the conductor layer of the third tubular conductor 33 has a diameter D3. In this case, when it is supposed that the first insulator 36 has a permeability value μ and an inductance element that occurs between the first tubular conductor 31 and the second tubular conductor 32 has an inductance value L1, the inductance value L1 is obtained by using an already-known formula (1) described below. Further, when it is supposed that the second insulator 37 has a permeability value μ and an inductance element that occurs between the third tubular conductor 33 and the second tubular conductor 32 has an inductance value L3, the inductance value L3 is obtained by using an already-known formula (2) described below.

$$L1=(\mu/2\pi)\mathrm{Log}(D2/D1) \quad (1)$$

$$L3=(\mu/2\pi)\mathrm{Log}(D3/D2) \quad (2)$$

As understood from the formula (1), when the permeability value μ is constant, the inductance value L1 is made small by making the thickness of the first insulator 36 small to cause the value of the diameter D2 to be close to the value of the diameter D1. Similarly, as understood from the formula (2), when the permeability value μ is constant, the inductance value L3 is made small by make the thickness of the first insulator 37 small to cause the value of the diameter D3 to be close to the value of the diameter D2. Accordingly, in the transmission cable 30, the adjustment of the thickness of the first insulator 36 and/or the thickness of the second insulator 37 enables adjustment of the magnitude of the inductance value L1 of the first tubular conductor 31 and the magnitude of the inductance value L3 of the third tubular conductor 33. Further, as understood from the formula (1) and the formula (2), when the permeability value μ is constant, an adjustment for causing a value of the division D2/D1 to be equal to a value of the division D3/D2 leads to an adjustment for causing the inductance value L1 to be equal to the inductance value L3. For example, the adjustment of the size of the diameter D2 of the circle drawn by the center of the thickness of the conductor layer of the second tubular conductor 32 enables a value of the division D2/D1 to be equal to a value of the division D3/D2. In other words, the adjustment of the size of the diameter D2 of the second tubular conductor 32 brings a balance in the inductance value (i.e., an electric property) to each of the first tubular conductor 31 and the third tubular conductor 33.

Further, as shown in FIG. 8, it is supposed that the first tubular conductor 31 has a conductor thickness T1 and a cross-sectional area S1; the second tubular conductor 32 has a conductor thickness T2 and a cross-sectional area S2; and the third tubular conductor 33 has a conductor thickness T3 and a cross-sectional area S3. In this case, when the first tubular conductor 31 has an electric resistivity value ρ and a cylindrical-axis-direction length CL, a resistance value R1 of the first tubular conductor 31 is obtained by using an already-known formula (3) described below. Further, when the third tubular conductor 33 has an electric resistivity value ρ and a cylindrical-axis-direction length CL, a resistance value R1 of the third tubular conductor 33 is obtained by using an already-known formula (4) described below.

$$R1=\rho CL/S1 \quad (3)$$

$$R3=\mu CL/S3 \quad (4)$$

As understood by the formula (3), when each of the electric resistivity ρ and the length CL is constant, the increase of the cross-sectional area S1, that is, the increase of the thickness of the conductor layer (i.e., the increase of the conductor thickness T1) and the increase of the diameter D1 of the circle drawn by the center of the thickness of the conductor layer make the resistance value R1 small. Similarly, as understood by the formula (4), when each of the electric resistivity ρ and the length CL is constant, the increase of the cross-sectional area S3, that is, the increase of the thickness of the conductor layer (i.e., the increase of the conductor thickness T3) and the increase of the diameter D3 of the circle drawn by the center of the thickness of the conductor layer make the resistance value R3 small. Accordingly, in the transmission cable 30, the adjustment of the thickness of the conductor layer and the diameter of the circle drawn by the center of the thickness of the conductor layer with respect to the first tubular conductor 31 and the third tubular conductor 33 enables adjustment of the magnitude of the resistance value R1 of the first tubular conductor 31 and the magnitude of the resistance value R3 of the third tubular conductor 33. Further, as understood from the formula (3) and the formula (4), when each of the electric resistivity value ρ and the length CL is constant, an adjustment for causing a value of the cross-sectional area S1 of the first tubular conductor 31 to be equal to a value of the cross-sectional area S3 of the third tubular conductor 33 leads to an adjust for causing the resistance value R1 to be equal to the resistance value R3.

Accordingly, an adjustment for making the resistance value R1 and the inductance value L1 small with respect to the first tubular conductor 31, which transmits the voltage signal COM-A, reduces the time delay and the voltage fluctuation in the transmitted voltage signal COM-A. Further, an adjustment for making the resistance value R3 and the inductance value L3 small with respect to the third tubular conductor 33, which transmits the voltage signal COM-B, reduces the time delay and the voltage fluctuation in the transmitted voltage signal COM-B. Moreover, an adjustment for respectively causing the resistance value and the inductance value of the first tubular conductor 31 to be equal to the resistance value and the inductance value of the third tubular conductor 33 enables transmission of the voltage signal COM-A and the voltage signal COM-B in a state in which the relative time delay and the relative voltage-value difference between the voltage signal COM-A and the voltage signal COM-B are reduced.

In addition, when the second tubular conductor 32 of the transmission cable 30 has an electric resistivity value ρ and a cylindrical-axis-direction length CL, the second tubular conductor 32 has a resistance value R2, which is obtained by using an already-known formula (5) described below.

$$R2=\rho CL/S2 \quad (5)$$

Naturally, in the transmission cable 30, an electric current flowing through the first tubular conductor 31, which transmits the voltage signal COM-A, and an electric current flowing through the second tubular conductor 32, which transmits the voltage signal COM-B, are returned to and flown in the second tubular conductor 32, which is in a constant-voltage applied state because of the transmission of the constant voltage VBS. For this reason, it is preferable the resistance value R2 of the second tubular conductor 32 is equal to each of the resistance value R1 of the first tubular conductor 31 and the resistance value R3 of the first tubular conductor 33.

Further, in the transmission cable 30 in this embodiment, the outer circumference of the first tubular conductor 31, which transmits the voltage signal COM-A, is covered by the second tubular conductor 32, which is in a constant-voltage applied state, so as to allow the first insulator 36 to be interposed between the outer circumference of the first tubular conductor 31 and the inner circumference of the second tubular conductor 32. Thus, when a disturbance, such as an electromagnetic wave, is applied to the transmission cable 30 from the outside, the second tubular conductor 32, which is in a constant-voltage applied state, serves as a shield layer and blocks the invasion of the electromagnetic wave into the first tubular conductor 31, which is disposed at the inner side of the cable. As a result, this configuration reduces the influence of such an electromagnetic wave (disturbance) applied from the outside on a large voltage-change ratio of a voltage that is supplied to a relevant piezoelectric element PZ in response to the occurrence of the maximum gradient of a signal waveform of the voltage signal COM-A.

The aforementioned configuration in this embodiment brings about the following advantageous effects.

(1) The aforementioned configuration enables the inductance value L1 and the resistance value R1 of the first tubular conductor 31 and the inductance value L3 and the resistance value R3 of the third tubular conductor 33 to be adjusted to small values without increasing the transmission cables 30 and without increasing the conductors included in the transmission cables 30, and thereby enables reduction of the distortion of each of the voltage signals COM-A and COM-B, which are transmitted to the liquid ejection head 25.

(2) The aforementioned configuration enables one of a plurality of voltage signals, that is, the voltage signal COM-A and the voltage signal COM-B, each having a signal waveform whose distortion is reduced, to be selectively supplied to each of the piezoelectric element PZ, and thereby enables increase of the printing quality of a printed image.

(3) The aforementioned configuration enables the second tubular conductor 32, which is in a state in which the generated constant voltage VBS is applied, to bring a balance of an electric property (an inductance value) to each of the first tubular conductor 31, which transmits the voltage signal COM-A, and the third tubular conductor 33, which transmits the voltage signal COM-B. Further, the aforementioned configuration enables the voltage value of the constant voltage VBS, which is generated by the constant voltage generation circuit 27, to be changed so as to allow a voltage supplied to each of the piezoelectric elements PZ, that is, a differential voltage between the output voltage VT and the constant voltage VBS, to be a voltage suitable for the property of the piezoelectric elements PZ.

(4) The aforementioned configuration enables, when printing is performed, a plurality of mutually different sized dots to be formed using a plurality of voltage signals transmitted to the liquid ejection head 25 and including a plurality of mutually different waveforms (in this this embodiment, the plurality of voltage signals being the two voltage signals COM-A and COM-B, for example, one being able to be used for forming a large size dot, the other one being able to be used for forming a small size dot).

(5) The aforementioned configuration allows the voltage signal COM-A, which includes a waveform whose gradient is large, that is, which has a large voltage-change ratio, to be transmitted in the transmission cable 30 by the first tubular conductor 31, disposed at the inner side of the second tubular conductor 32, which is in a state in which a constant voltage (the constant voltage VBS) is applied, and thus, reduces an influence applied from the outside on the voltage change.

(6) In the aforementioned embodiment, the printing apparatus 11 is provided with the plurality of (four) transmission cables 30, which are arranged in a mutually parallel state, and this configuration realizes the disposition of the plurality of transmission cables 30 in a state in which mutual influences of crosstalk on the individual transmission cables 30 are reduced and integrally bending of the transmission cables 30 is facilitated.

In addition, the aforementioned embodiment may be changed into modification examples described below. Further, the aforementioned embodiment and individual modification examples described below may be combined in any appropriate manner.

In the aforementioned embodiment, without supplying the two mutually different voltage signals COM-A and COM-B to each of the piezoelectric elements PZ in the method shown in FIG. 6, the voltage supply unit 40 may supply the voltage signal COM-A to one of mutually different piezoelectric elements PZ and supply the voltage signal COM-B to the other one of the mutually different piezoelectric elements PZ.

Figure 9:
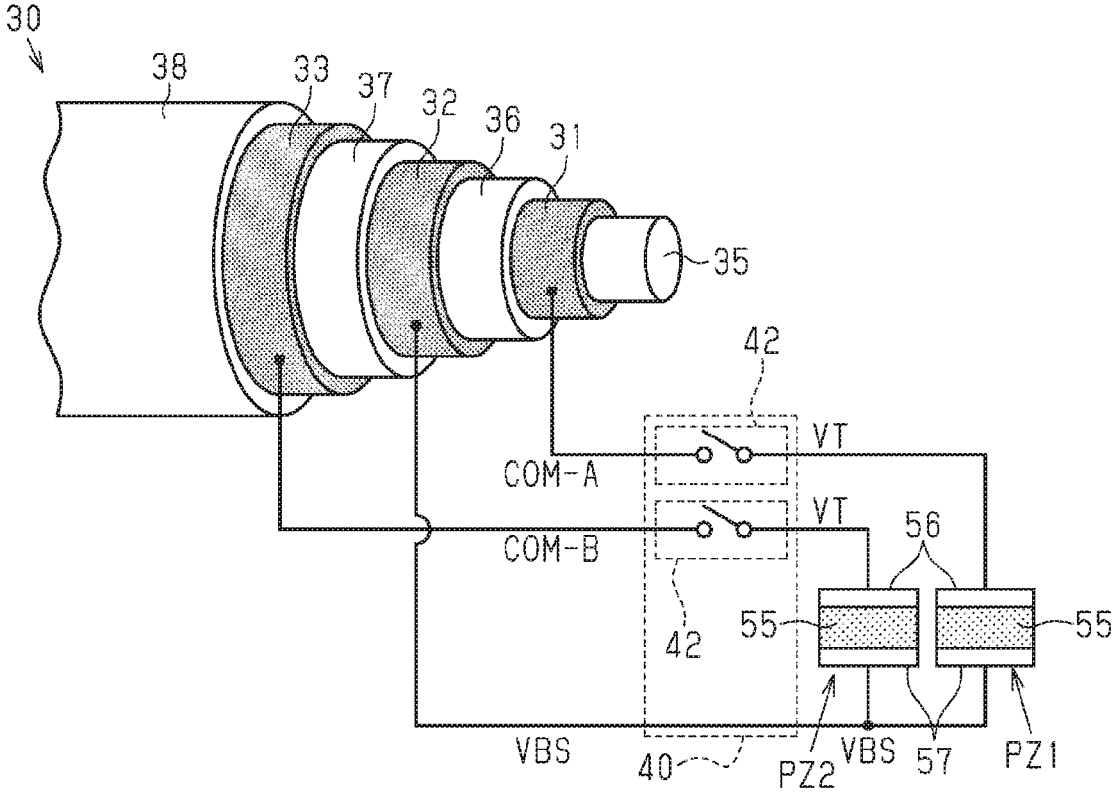
FIG. 9 is a configuration diagram illustrating a configuration in which voltage signals each transmitted by a corresponding one of tubular conductors of a transmission cable are supplied to a plurality of piezoelectric elements.

That is, as shown in FIG. 9, a liquid ejection head 25 in this modification example is provided with a plurality of piezoelectric elements PZ including first piezoelectric elements PZ1 and second piezoelectric elements PZ2. Further, the voltage supply unit 40 supplies the voltage signal COM-A, which serves as the output voltage VT, to the first electrode 56 of each of the first piezoelectric elements PZ1, and supplies the voltage signal COM-B, which serves as the output voltage VT, to the first electrode 56 of each of the second piezoelectric elements PZ2. Further, the voltage supply unit 40 supplies the constant voltage VBS to the second electrode 57 of each the first piezoelectric elements PZ1 and the second electrode 57 of each of the second piezoelectric elements PZ2.

In this modification example, the voltage supply unit 40 includes the selection units 42 each associated with a corresponding one of the first piezoelectric elements PZ1 and the selection units 42 each associated with a corresponding one of the second piezoelectric elements PZ2. Further, each of the selection units 42, which is associated with a corresponding one of the first piezoelectric elements PZ1, selects "ON" or "OFF", whichever is specified by a corresponding piece of printing data, the "ON" being a state in which the voltage signal COM-A, which is transmitted by the first tubular conductor 31 of the transmission cable 30, is output to the first electrode 56 of the corresponding one of the first piezoelectric elements PZ1, the "OFF" being a state in which the voltage signal COM-A is not output to the first electrode 56 of the corresponding one of the first piezoelectric elements PZ1. Further, each of the selection units 42, which is associated with a corresponding one of the second piezoelectric elements PZ2, selects "ON" or "OFF", whichever is specified by a corresponding piece of printing data, the "ON" being a state in which the voltage signal COM-B, which is transmitted by the third tubular conductor 33 of the transmission cable 30, is output to the first electrode 56 of the corresponding one of the second piezoelectric elements PZ2, the "OFF" being a state in which the voltage signal COM-B is not output to the first electrode 56 of the corresponding one of the second piezoelectric elements PZ2.

Accordingly, the voltage signal COM-A, which is one of the two kinds of voltage signals transmitted by one of the transmission cables 30, is selectively supplied (or is selectively not supplied) to the first electrode 56 of each of the first piezoelectric elements PZ1, and the voltage signal COM-B, which is the other one of the two kinds of voltage signals transmitted by the one of the transmission cables 30, is selectively supplied (or is selectively not supplied) to the first electrode 56 of each of the second piezoelectric elements PZ2. As a result, each of the first piezoelectric elements PZ1 is contracted and elongated in accordance with the differential voltage between the voltage, supplied to the first electrode 56 of the relevant first piezoelectric element PZ1, and the constant voltage VBS, supplied to the second electrode 57 of the relevant first piezoelectric element PZ1; and each of the second piezoelectric elements PZ2 is contracted and elongated in accordance with the differential voltage between the voltage, supplied to the first electrode 56 of the relevant second piezoelectric element PZ2, and the constant voltage VBS, supplied to the second electrode 57 of the relevant second piezoelectric element PZ2.

In addition, in this modification example, the first piezoelectric elements PZ1 are disposed in the ejection mechanism 50 of one of the head units 26, which includes the nozzles N through which yellow ink is ejected; and the second piezoelectric elements PZ2 are disposed in the ejection mechanism 50 of another one of the head units 26, which includes the nozzles N through which black ink is ejected.

This modification example shown in FIG. 9 brings about the following advantageous effect in substitution for the advantageous effect (2) in the aforementioned embodiment.

(7) The configuration of this modification example allows the voltage signal COM-A and the voltage signal COM-B to be each supplied to the piezoelectric elements PZ included in a corresponding one of two head units 26 each associated with a corresponding one of mutually different ink cartridges 24. Accordingly, the configuration of this modification example allows two different kinds of inks (two differently colored inks in this embodiment) to be each ejected from the liquid ejection head 25 by a corresponding one of the voltage signals COM-A and COM-B, which are transmitted through one of the transmission cables 30. Further, the configuration of this modification example allows the liquid ejection head 25 to eject four kinds of inks (four colored inks) through the nozzles N using two transmission cables 30, and thus, reduces the interference of the transmission cables 30 with the movement of the carriage 23.

Alternatively, in the modification example shown in FIG. 9, the first piezoelectric elements PZ1 and the second piezoelectric elements PZ2 may be disposed in one head unit 26. For example, with respect to the nozzles N, which are arranged in two rows in the transport direction Y in one head unit 26, as shown in FIG. 2, piezoelectric elements PZ included in an ejection mechanism 50 associated with one of the two rows may be made the first piezoelectric elements PZ1, and piezoelectric elements PZ included in an ejection mechanisms 50 associated with the other one of the two rows may be made the second piezoelectric elements PZ2. This configuration enables one head unit 26 to, for example, simultaneously eject ink droplets through a large number of nozzles N.

In the aforementioned embodiment, each of the transmission cables 30 may not be configured to include the three tubular conductors, but may be configured to include two tubular conductors.

Figure 10:
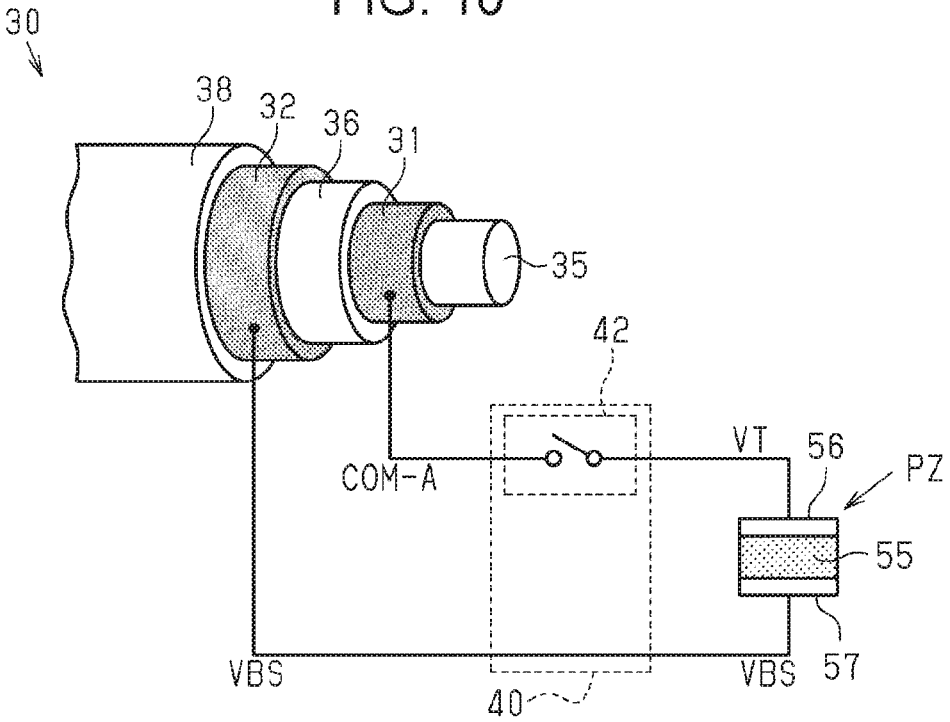
FIG. 10 is a configuration diagram illustrating the structure of a transmission cable including tubular conductors of two layers, and a configuration in which voltage signals each transmitted by a corresponding one of the tubular conductors are supplied to a piezoelectric element.

For example, as shown in FIG. 10, each of the transmission cables 30 may include the first tubular conductor 31 and the second tubular conductor 32. In this case, the first tubular conductor 31 includes a hollow core, and the second tubular conductor 32 is disposed over the outer circumference of the first tubular conductor 31 so as to interpose the first insulator 36 between the outer circumference of first tubular conductor 31 and the inner circumference of the second tubular conductor 32. Further, in this modification example shown in FIG. 10, similarly, the columnar insulator 35 is inserted in the hollow core of the first tubular conductor 31 so that the tubular shape of the first tubular conductor 31 is not deformed. Further, the outer coating layer 38 covers the outer circumference of the second tubular conductor 32. Further, the first tubular conductor 31 and the second tubular conductor 32 have approximately cylindrical shapes having concentric axes, and are each formed of a conductive metal plate (including a thin plate or foil) or a metallic braided wire assembly. Thus, each of the transmission cables 30 is a coaxial cable including two tubular conductors having concentric axes.

In the modification example shown in FIG. 10, each of the transmission cables 30, which is configured in such a manner as described above, is coupled to the voltage signal generation circuit 22 so as to allow one voltage signal (the voltage signal COM-A in this case) to be transmitted by the first tubular conductor 31, and allow the constant voltage VBS to be transmitted by the second tubular conductor 32. Thus, in each of the transmission cables 30, the first tubular conductor 31 is in a state in which a voltage varies, and the second tubular conductor 32 is in a state in which a constant voltage is applied.

In the case of this modification example, the voltage supply unit 40, which is disposed at the side of the liquid ejection head 25 coupled to one of the transmission cables 30, supplies the voltage signal COM-A to the first electrode 56 of each of the piezoelectric elements PZ, and supplies the constant voltage VBS to the second electrode 57 of the each of the piezoelectric elements PZ. Further, the voltage supply unit 40 includes the selection units 42 each associated with a corresponding one of the piezoelectric elements PZ, and each of the selection units 42 selects "ON" or "OFF", whichever is specified by a corresponding piece of printing data, the "ON" being a state in which the voltage signal COM-A, which is transmitted by the first tubular conductor 31 of the relevant transmission cable 30, is output to the first electrode 56 of a corresponding one of the piezoelectric elements PZ, the "OFF" being a state in which the voltage signal COM-A is not output to the first electrode 56 of the corresponding one of the piezoelectric elements PZ.

Accordingly, the first electrode 56 and the second electrode 57 of each of the piezoelectric elements PZ are respectively supplied with the voltage signal COM-A and the constant voltage VBS, which are transmitted by one of the transmission cables 30. As a result, each of the piezoelectric elements PZ is contracted and elongated in accordance with the differential voltage between the voltage supplied with a corresponding one of the first electrodes 56 and the constant voltage VBS supplied with a corresponding one of the second electrodes 57.

The configuration of the transmission cable 30, shown in FIG. 10, brings about advantageous effects similar to those of the configuration of the transmission cable 30 in the aforementioned embodiment.

That is, the inductance value L1 arising in the first tubular conductor 31 is made small by making the thickness of the first insulator 36 small and making the distance between the first tubular conductor 31 and the second tubular conductor 32 small. Accordingly, in the transmission cable 30, the adjustment of the thickness of the first insulator 36 enables adjustment of the magnitude of the inductance value L1 of the first tubular conductor 31. Further the resistance value R1 of the first tubular conductor 31 is made small by making the cross-sectional area S1 of the first tubular conductor 31 large, that is, making the thickness of the conductor layer large (making the conductor thickness T1 large) and/or making the diameter D1 of the circle drawn by the center of the thickness of the conductor layer large.

As a result, the configuration of the transmission cable 30, shown in FIG. 10, enables adjustment of the magnitudes of the inductance value L1 and the resistance value R1 of the first tubular conductor 31, and thus, enables reduction of the distortion of the voltage signal (the voltage signal COM-A in this case) transmitted to the liquid ejection head 25.

In the aforementioned embodiment, the liquid ejection head 25 may not be necessarily provided with such voltage supply units 40 each configured to selectively supply one of the voltage signal COM-A and the voltage signal COM-B to the first electrode 56 of each of the piezoelectric elements PZ, and supply the constant voltage VBS to the second electrode 57 of the each of the piezoelectric elements PZ. For example, the voltage supply unit 40 may be configured so as only to selectively supply one of the voltage signal COM-A and the voltage signal COM-B to the first electrode 56 of each of the piezoelectric elements PZ. In this case, the second electrode 57 of each of the piezoelectric elements PZ may be coupled to, in the liquid ejection head 25, for example, a pattern provided on the sub-substrate of the head unit 26 and coupled to a constant voltage. Alternatively, the second electrode 57 of each of the piezoelectric elements PZ may be coupled to the carriage 23 electrically coupled to the frame 12 having a constant electric potential, that is, a ground electric potential, so as to be coupled to the frame 12 via the carriage 23.

In the aforementioned embodiment, each of the constant voltage transmitted by the second tubular conductor 32 and the constant voltage supplied to the second electrode 57 of each of the piezoelectric element PZ may not necessarily be the constant voltage VBS, generated by the constant voltage generation circuit 27. For example, in the aforementioned embodiment, the second tubular conductor 32 may be coupled to a ground electric potential so as to be kept to a constant voltage. In addition, in this case, the constant voltage of the second tubular conductor 32 of the transmission cable 30 and the constant voltage supplied to the second electrode 57 of each of the piezoelectric elements PZ may be voltage values different from each other, provided that the voltage values are constant voltage values.

In the aforementioned embodiment, the voltage signal COM-A and the voltage signal COM-B, which are transmitted by each of the transmission cables 30, may have the same waveform in each printing cycle. Alternatively, the voltage signal COM-A and the voltage signal COM-B may have the same waveform in the anterior half of each printing cycle, or may have the same waveform in the posterior half of each printing cycle.

In the aforementioned embodiment, a maximum gradient value among the values of gradients included in the voltage signal COM-A may be a gradient value of the voltage falling portion (not illustrated) of the trapezoidal waveform Adp1 or a gradient value of the voltage falling portion (not illustrated) of the trapezoidal waveform Adp2. In this case, the gradient value of this voltage falling portion is a value larger than a maximum gradient value among the values of gradients included in the voltage signal COM-B.

In the aforementioned embodiment, a maximum gradient value among the values of gradients included in the voltage signal COM-A may not be necessarily larger than a maximum gradient value among the values of gradients included in the voltage signal COM-B. For example, a maximum gradient value among the values of gradients included in the voltage signal COM-A and a maximum gradient value among the values of gradients included in the voltage signal COM-B may be the same value. Alternatively, in the case where, for example, any electromagnetic wave is not applied from the outside, or an electromagnetic wave is applied from the center side (i.e., from the insulator 35 side), a maximum gradient value among the values of gradients included in the voltage signal COM-B may be a value larger than a maximum gradient value among the values of gradients included in the voltage signal COM-A.

In the aforementioned embodiment, the printing apparatus 11 may not necessarily be provided with the plurality of transmission cables 30 arranged in a mutually parallel state. For example, in a configuration in which the liquid ejection head 25 is not moved in the width direction of the paper P or in a configuration in which, even when the liquid ejection head 25 is moved, the distance of the movement is short, the transmission cables 30 may not be necessary configured so as to be arranged in a mutually parallel state that allows integrally bending to be facilitated.

In the above modification example shown in FIG. 9 or the above modification example shown in FIG. 10, the liquid ejection head 25 may not be necessarily provide with such voltage supply units 40 each configured to supply the constant voltage VBS to the second electrode 57 of each of the piezoelectric elements PZ corresponding to the relevant voltage supply unit 40. That is, the second electrode 57 of each of the first piezoelectric elements PZ1 as well as the second electrode 57 of each of the second piezoelectric elements PZ2 may be coupled to, in the liquid ejection head 25, a pattern provided on the sub-substrate of the head unit 26 and coupled to a constant voltage. Alternatively, the second electrode 57 of each of the first piezoelectric elements PZ1 as well as the second electrode 57 of each of the second piezoelectric elements PZ2 may be coupled to the carriage 23 electrically coupled to the frame 12 having a constant electric potential, that is, a ground electric potential, so as to be coupled to the frame 12 via the carriage 23.

In the above modification example shown in FIG. 9 or the above modification example shown in FIG. 10, each of the constant voltage transmitted by the second tubular conductor 32 and the constant voltage supplied to the second electrode 57 of each of the piezoelectric element PZ may not necessarily be the constant voltage VBS, generated by the constant voltage generation circuit 27. For example, the second tubular conductor 32 may be coupled to a ground electric potential so as to be kept to a constant voltage. In addition, in this case, the constant voltage of the second tubular conductor 32 of the transmission cable 30 and the constant voltage supplied to the second electrode 57 of each of the piezoelectric elements PZ may be voltage values different from each other, provided that the voltage values are constant voltage values.

In the above embodiment, the above modification example shown in FIG. 9, or the above modification example shown in FIG. 10, the transmission cable 30 may have a discrepancy or discrepancies among the positions of the centers (tube centers) of the individual tubular conductors any two adjacent ones of which interpose an insulator therebetween. Further, the cross-sectional shape of the transmission cable 30 may be a shape similar to a circular shape (for example, an elliptical shape). Naturally, it is preferable that the positions of the centers (tube centers) of the individual tubular conductors are placed on the same position, and the cross-sectional shape of the transmission cable 30 is the circular shape.

In the above embodiment, the above modification example shown in FIG. 9, or the above modification example shown in FIG. 10, the insulator 35 may not inserted in the hollow core of the first tubular conductor 31. For example, in the case where, in the transmission cable 30, the first tubular conductor 31 is unlikely to be deformed, the core of the first tubular conductor 31 may remain hollow.

In the above embodiment, the above modification example shown in FIG. 9, or the above modification example shown in FIG. 10, in the transmission cable 30, an columnar shaped conductor may be inserted in the hollow core of the first tubular conductor 31 in substitution for the insulator 35. A columnar shaft formed of a conductive metal plate (including a thin plate or foil) or a metallic braided wire assembly, which is the same member as the member forming the first tubular conductor 31, may be employed as the columnar shaped conductor. In addition, in the case where the columnar shaped conductor is formed of the same member as the member forming the first tubular conductor 31, in the transmission cable 30, the first tubular conductor 31 may be made a columnar shaped conductor whose core is not hollow.

In the aforementioned embodiment, the inks may be supplied, not from the cartridges 24, but from, for example, ink tanks (not illustrated) provided at the outside of the frame 12.

The printing apparatus 11 in the aforementioned embodiment may be, for example, a large format printer that performs printing (recording) on a long medium, an example of the printer P. In this case, in the printing apparatus 11, the paper P may be wound in a roll shape, and may be unwound from the roll when transported toward the medium supporting table 3.

In the aforementioned embodiment, the printing apparatus 11 may be a so-called full-line type printer in which the liquid ejection head 25 is not provided in the carriage 23 and the head unit 26 is a fixed head unit whose long-length side corresponds to the entire width of the paper P. In this case, the plurality of nozzles N, which are provided in the head unit 26, are arranged so as to cover across the entire width of the paper P in the scan direction X.

In the aforementioned embodiment, the liquid for use in printing may be a fluid other than the ink (i.e., a liquid; a liquid-state substance resulting from dispersing or mixing particles of a functional material into a liquid; a fluid-state substance like gel; a substance flown as a fluid and containing an ejectionable solid). For example, a configuration that, in recording processing, allows a liquid-state substance containing a production material in the form of dispersion or dissolution to be ejected may be employed. Non-limiting examples of such a production material includes an electrode material and a color material, each of which is a material of a pixel electrode and is used for, for example, the production of a display, such as a liquid crystal display, an electro-luminescence (EL) display, or a plane emission display.

In the aforementioned embodiment, the printing apparatus 11 may be a fluid-state substance ejecting apparatus or a powder particle ejecting apparatus. In this case, the fluid-state substance ejecting apparatus ejects a fluid-state substance, such as gel (for example, physical gel). The powder particle ejecting apparatus ejects a solid, such as powder or powder particles (for example, toner), and a non-limiting example of the powder particle ejecting apparatus is a toner jet recording apparatus. In addition, in this specification, the "fluid" is a concept that does not include a fluid composed of only gas, and non-limiting examples of the "fluid" include liquids, such as an inorganic solvent, an organic solvent, solution, liquid resin, liquid metal (metallic melt); a liquid-state substance; a fluid-state substance; and a powder-particle substance (including powder and particles).

In the aforementioned embodiment, the printing apparatus 11 is not limited to a printer that performs recording by ejecting fluids, such as inks, but may be a non-impact printer, such as a laser printer, an LED printer, or a thermal-transfer printer (including a dye-sublimation printer), or an impact printer, such as a dot-impact printer.

In the aforementioned embodiment, the medium is not limited to the paper P, but may be a thin plate material, such as a plastic film, or cloth used in a print device or any other similar device.

What is claimed is:

1. A printing apparatus comprising:

a voltage signal generation circuit configured to generate a plurality of voltage signals including a first voltage signal and a second voltage signal;

at least one transmission cable configured to transmit the plurality of voltage signals, each of the at least one transmission cable including a first tubular conductor including a hollow core and configured to transmit the first voltage signal, a second tubular conductor disposed over an outer circumference of the first tubular conductor with a first insulator between the outer circumference of the first tubular conductor and an inner circumference of the second tubular conductor and being in a constant-voltage applied state, and a third tubular conductor disposed over an outer circumference of the second tubular conductor with a second insulator between the outer circumference of the second tubular conductor and an inner circumference of the third tubular conductor and configured to transmit the second voltage signal; and a liquid ejection head including a plurality of piezoelectric elements and configured to receive the plurality of voltage signals, transmitted by the at least one transmission cable, and to supply each of at least one specified piezoelectric element among the piezoelectric elements with one of the received voltage signals so as to allow the each of at least one specified piezoelectric element to eject liquid.

2. The printing apparatus according to claim 1, wherein the liquid ejection head includes a voltage supply unit configured to selectively supply one of the first voltage signal and the second voltage signal to one electrode of one of the piezoelectric elements, and to supply a constant voltage to another electrode of the one of the piezoelectric elements.

3. The printing apparatus according to claim 1, wherein the liquid ejection head includes a voltage supply unit including the plurality of piezoelectric elements including a first piezoelectric element and a second piezoelectric element, and the voltage supply unit is configured to supply the first voltage signal to one electrode of the first piezoelectric element, supply the second voltage signal to one electrode of the second piezoelectric element, and supply a constant voltage to another electrode of the first piezoelectric element and another electrode of the second piezoelectric element.

4. The printing apparatus according to claim 1, further comprising a constant voltage generation circuit configured to generate a constant voltage that is a same as the constant voltage.

5. The printing apparatus according to claim 1, wherein a signal waveform of the first voltage signal, transmitted by the transmission cable, and a signal waveform of the second voltage signal, transmitted by the transmission cable, are different from each other.

6. The printing apparatus according to claim 5, wherein a maximum value among values of gradients included in the signal waveform of the first voltage signal is larger than a maximum value among values of gradients included in the signal waveform of the second voltage signal.

7. The printing apparatus according to claim 1, wherein the at least one transmission cable includes a plurality of transmission cables, and the plurality of transmission cables are provided in a mutually parallel state.

8. A transmission cable for use in transmission of a plurality of voltage signals including a first signal and a second signal and generated by a voltage signal generation circuit to a liquid ejection circuit including a plurality of piezoelectric elements and configured to supply each of at least one specified piezoelectric element among the piezoelectric elements with one of the voltage signals so as to allow the each of at least one specified piezoelectric element to eject liquid, the transmission cable comprising:

a first tubular conductor including a hollow core and configured to transmit the first voltage signal;

a second tubular conductor disposed over an outer circumference of the first tubular conductor with a first insulator between the outer circumference of the first tubular conductor and an inner circumference of the second tubular conductor and being in a constant-voltage applied state; and a third tubular conductor disposed over an outer circumference of the second tubular conductor with a second insulator between the outer circumference of the second tubular conductor and an inner circumference of the third tubular conductor and configured to transmit the second voltage signal.

* * * * *